US007221880B2

(12) United States Patent
Jeong et al.

(10) Patent No.: US 7,221,880 B2
(45) Date of Patent: May 22, 2007

(54) WASTE TONER TRANSFER APPARATUS AND ELECTROPHOTOGRAPHIC PRINTER USING THE SAME

(75) Inventors: Heung-sup Jeong, Suwon-si (KR); Jae-myoung Choi, Suwon-si (KR); Jin-soo Lee, Suwon-si (KR); Se-hyun Lyu, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 211 days.

(21) Appl. No.: 10/835,297

(22) Filed: Apr. 30, 2004

(65) Prior Publication Data

US 2005/0002708 A1 Jan. 6, 2005

(30) Foreign Application Priority Data

Jul. 4, 2003 (KR) ..... 10-2003-0045386

(51) Int. Cl.
*G03G 21/12* (2006.01)
*G03G 21/10* (2006.01)

(52) U.S. Cl. ..... 399/35; 399/358; 399/360

(58) Field of Classification Search ..... 222/DIG. 1; 399/34, 35, 123, 343, 344, 345, 350–353, 399/357–360

See application file for complete search history.

(56) References Cited

U.S. PATENT DOCUMENTS 5,708,952 A * 1/1998 Taniguchi et al. ..... 399/358
6,085,062 A 7/2000 Mizuishi et al. ..... 399/358
6,266,511 B1 7/2001 Murakami et al. ..... 399/358
6,516,172 B1 * 2/2003 Kimura ..... 399/257
7,068,968 B2 * 6/2006 Choi et al. ..... 399/360
7,099,617 B2 * 8/2006 Jeong et al. ..... 399/358

FOREIGN PATENT DOCUMENTS

| | | |
|---|---|---|
| EP | 0 899 632 A2 | 3/1999 |
| JP | 58102269 | 6/1983 |
| JP | 61169422 | 7/1986 |
| JP | 11-024524 | 1/1999 |
| JP | 11-084968 | 3/1999 |
| KR | 1999-029393 | 4/1999 |

* cited by examiner

*Primary Examiner*—Hoang Ngo
(74) *Attorney, Agent, or Firm*—Roylance, Abrams, Berdo & Goodman, L.L.P.

(57) ABSTRACT

A waste toner transfer apparatus in an electrophotographic printer transfers waste toner removed by a cleaning unit from an image holding body where a toner image is temporarily held to a waste toner storage container. The waste toner transfer apparatus includes a duct connecting the cleaning unit and the storage container, a transfer unit installed in the duct and transferring the waste toner to the storage container, and an agitation member installed in the duct to move therein and guide the waste toner from the cleaning unit to the transfer unit.

38 Claims, 6 Drawing Sheets

WASTE TONER TRANSFER APPARATUS AND ELECTROPHOTOGRAPHIC PRINTER USING THE SAME

BACKGROUND OF THE INVENTION

This application claims the benefit under 35 U.S.C. §119 (a) of Korean Patent Application No. 2003-45386, filed on Jul. 4, 2003, in the Korean Intellectual Property Office, the entire disclosure of which is incorporated herein by reference.

1. Field of the Invention

The present invention relates to an electrophotographic printer. More particularly, the present invention relates to a waste toner transfer apparatus to transfer waste toner generated during a printing process to a waste toner storage container and an electrophotographic printer using the same.

2. Description of the Related Art

In an image forming process of an electrophotographic printer, when an exposure unit scans light corresponding to image information onto a photoreceptor charged to a predetermined electric potential, an electrostatic latent image is formed on the photoreceptor. A developing unit supplies toner to the electrostatic latent image to form a toner image. Generally, four developing units containing cyan, magenta, yellow, and black toners are needed for a color electrostatic latent printer. The toner image is transferred to a recording medium directly, or via an intermediate medium, from the photoreceptor. While the recording medium passes through a fusing unit, the toner image is fused on the recording medium by heat and pressure. As a result of the above processes, a mono or color image is printed on the recording medium.

While a wet type electrophotographic printer uses a wet developer formed by dispersing toner powder in a liquid carrier, a dry type electrophotographic printer uses toner powder as a developer. In this case, waste toner remaining on a photoreceptor or on an intermediate transfer medium during the image forming process is removed therefrom and is collected in a storage container. The electrophotographic printer typically includes a waste toner transfer apparatus to transfer waste toner to the storage container.

FIG. 1 is a view illustrating a conventional waste toner transfer apparatus. Referring to FIG. 1, a cleaning apparatus 1 removes waste toner from a photoreceptor or an intermediate transfer medium (not shown). The waste toner removed by the cleaning apparatus 1 is transferred by a waste toner transfer apparatus 2 to a storage container (not shown). The waste toner enters a duct 4 through an inlet portion 3. A shaft 5 rotated by a drive motor 6 is installed in the duct 4 and a conveying coil 7 is coupled to an end portion of the shaft 5. The duct 4 and the storage container are connected by a pipe 8. The conveying coil 7 is installed to extend through the inside of the pipe 8. The waste toner entering the duct 4 through the inlet portion 3 is transferred by the conveying coil 7 to the storage container along the pipe 8. The inlet portion 3 is generally formed to be inclined downward from the cleaning apparatus 1 toward the duct 4 so that the waste toner can slide and enter the duct 4 by gravity.

In the waste toner transfer apparatus 2 configured as above, although the waste toner is supposed to slide down by gravity along the inclined inlet portion 3, waste toner particles sometimes coagulate into a waste toner lump due to an attraction force between the toner particles, and may adhere to an inner wall of the inlet portion 3, especially the lower wall. When absorbing moisture in the air, the waste toner lump is further increased so that the inlet portion 3 is narrowed or clogged. When the inlet portion 3 is narrowed or clogged, waste toner accumulates in the cleaning apparatus 1. Accordingly, the accumulated waste toner in the cleaning apparatus 1 may further harden in time. In this case, the waste toner may exert a load on the transfer unit 9 installed in the cleaning apparatus 1 to transfer the waste toner toward the inlet portion 3 so that the transfer unit 9 may be damaged. Further, the waste toner in the cleaning apparatus 1 exposed to the outside may contaminate the electrophotographic printer.

SUMMARY OF THE INVENTION

To solve the above and/or other problems, embodiments of the present invention provide a waste toner transfer apparatus which effectively transfers waste toner removed from an image holding body such as a photoreceptor or an intermediate transfer medium to a waste toner storage container, so that the waste toner does not accumulate during the transfer process, and an electrophotographic printer having the same.

According to an aspect of the present invention, there is provided a waste toner transfer apparatus in an electrophotographic printer to transfer waste toner removed by a cleaning unit from an image holding body where a toner image is temporarily held to a waste toner storage container. The waste toner transfer apparatus comprises a duct connecting the cleaning unit and the storage container, a transfer unit installed in the duct to transfer the waste toner to the storage container, and an agitation member installed in the duct to move therein and guide the waste toner from the cleaning unit to the transfer unit.

According to another aspect of the present invention, there is provided an electrophotographic printer including an image holding body for temporarily holding a toner image in an image forming process, a cleaning unit for removing waste toner remaining on the image holding body, a waste toner storage container, and a waster toner transfer apparatus for transferring the waste toner from the cleaning unit to the storage unit. The waste toner transfer apparatus comprises a duct connecting the cleaning unit and the storage container, a transfer unit installed in the duct to transfer the waste toner to the storage container, and an agitation member installed in the duct to move therein and guide the waste toner from the cleaning unit to the transfer unit.

The agitation member moves by being engaged with the transfer unit. The transfer unit comprises an auger having a shaft and a spiral wing formed on an outer circumference of the shaft, and one end of the agitation member contacts the auger so that the agitation member moves as the auger rotates. The agitation member is preferably formed of an elastically deformable material and elastically contacts the auger. The transfer unit further comprises a conveying coil having one end portion coupled to the shaft and a spiral coil shape extended to the storage container. The conveying coil rotates as the auger rotates.

The duct comprises a first duct extending downward from the cleaning unit, a second duct connected to the first duct, in which the auger is installed, and a third duct connecting the second duct and the storage container, in which the conveying coil is installed. The agitation member is preferably installed in the first duct.

In another embodiment, the transfer unit comprises a shaft which rotates, and a conveying coil inserted around one end portion of the shaft, having a spiral coil shape extending to the storage container, and rotated by the shaft. In this embodiment, the agitation member has one end contacting the conveying coil so that it moves as the conveying coil rotates.

BRIEF DESCRIPTION OF THE DRAWINGS

The above and other features and advantages of the present invention will become more apparent by describing in detail preferred embodiments thereof with reference to the attached drawings in which.

Throughout the drawings, it should be understood that like reference numbers refer to like features and structures.

DETAILED DESCRIPTION OF THE PREFERRED EMBODIMENTS

Figure 1:
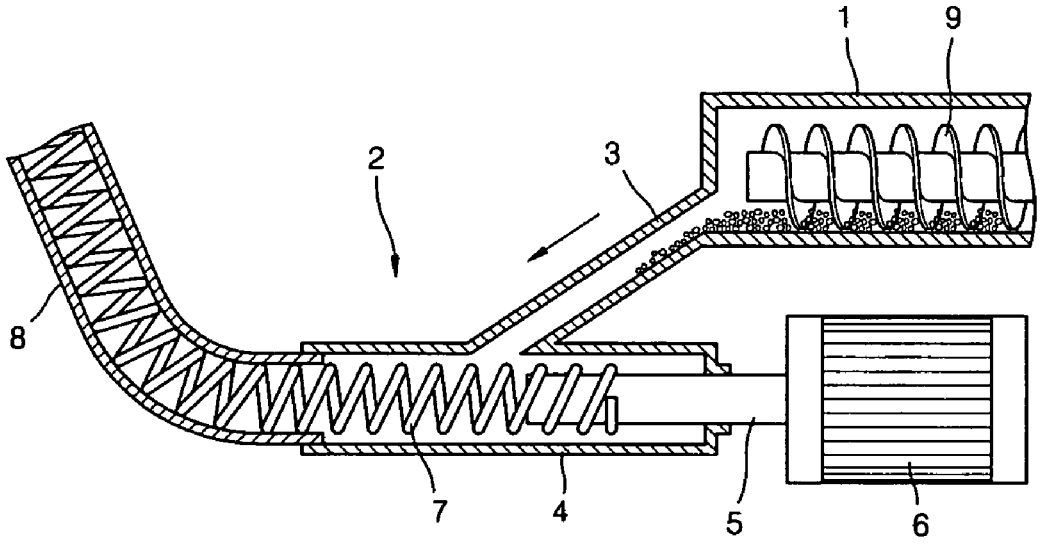
FIG. 1 (PRIOR ART)
FIG. 1 is a view illustrating a conventional waste toner transfer apparatus.
Figure 2:
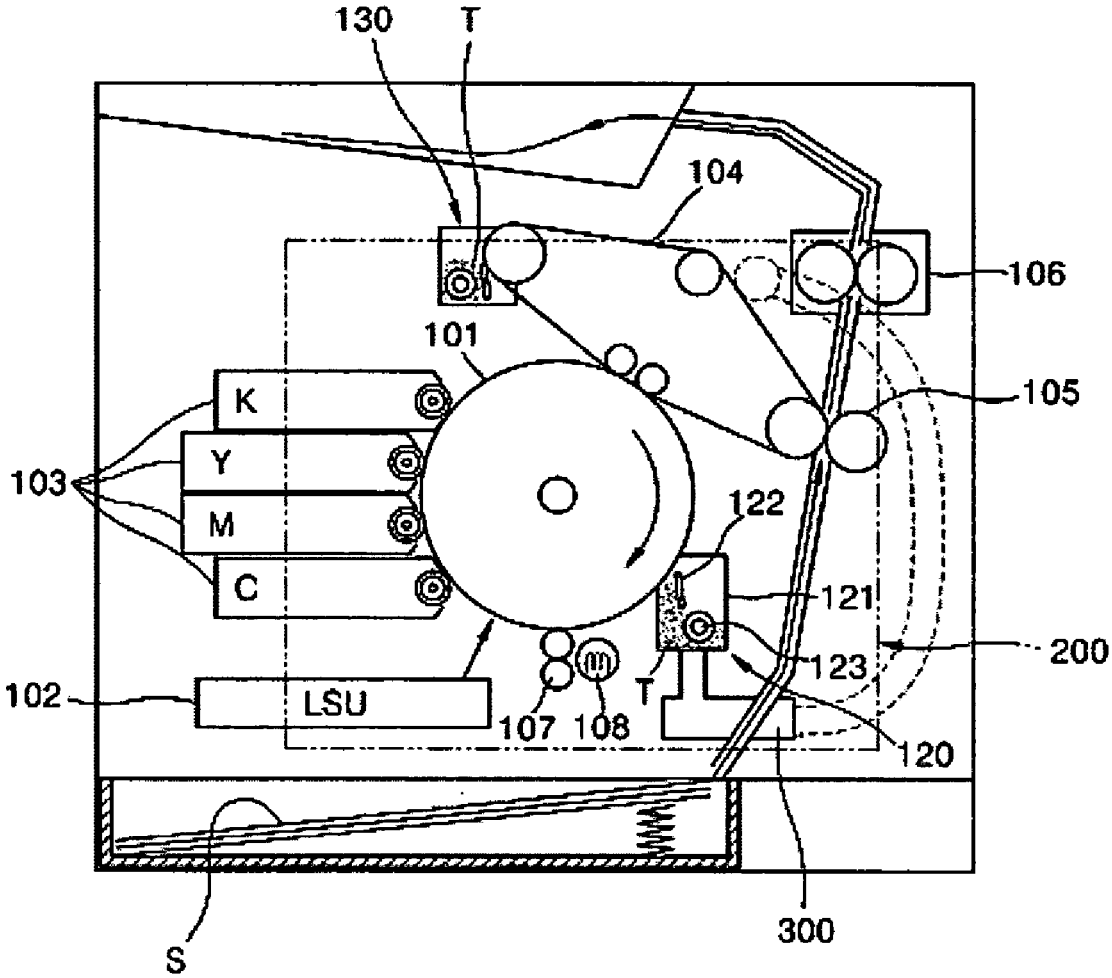
FIG. 2 is a view illustrating a structure of an electrophotographic printer according to an embodiment of the present invention.

Referring to FIG. 2, an electrophotographic printer according to an embodiment of the present invention includes a photoreceptive drum 101, an exposure unit 102, a developing unit 103, and a transfer belt 104.

Figure 3:
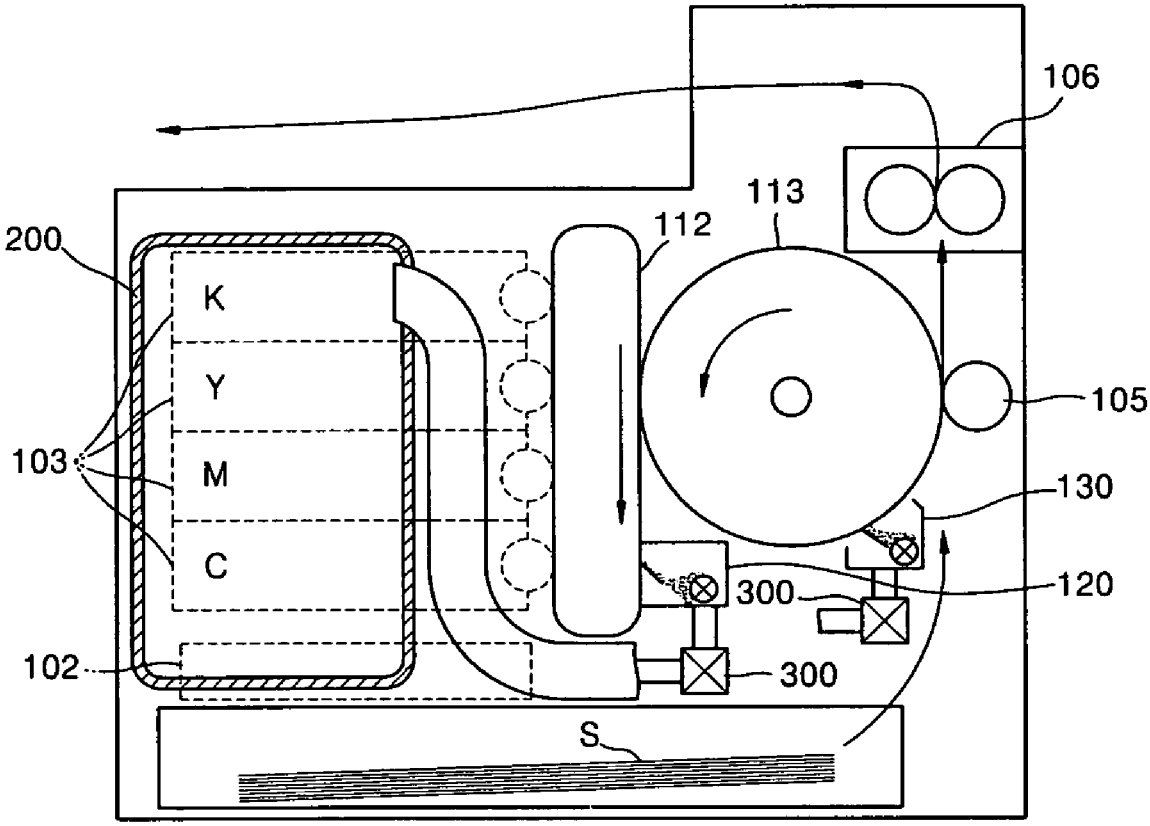
FIG. 3 is a view illustrating a structure of an electrophotographic printer according to another embodiment of the present invention.

The photoreceptive drum 101, as an example of a photoreceptor, has a photoconductive substance layer formed on the outer circumferential surface of a metal drum. A photoreceptive belt 112 as shown in FIG. 3 can be used instead of the photoreceptive drum 101.

The exposure unit 102 forms an electrostatic latent image by scanning light corresponding to image information onto the photoreceptor drum 101 charged to have a uniform electric potential. Generally, a laser scanning unit (LSU) using a laser diode as a light source is used as the exposure unit 102.

Four developing units 103C, 103M, 103Y, and 103K contain solid powder toners of cyan (C), magenta (M), yellow (Y), and black (K) colors, respectively, and provide the toners to the electrostatic latent image formed on the photoreceptive drum 101 to form toner images.

The transfer belt 104 is an example of an intermediate transfer medium which transfers the toner image received from the photoreceptor to a recording medium S. A transfer drum 113 as shown in FIG. 3 can be used instead of the transfer belt 104. The toner images, sequentially formed on the photoreceptive drum 101, for the cyan (C), magenta (M), yellow (Y), and black (K) colors are transferred to the transfer belt 104 to be overlapped so that a color toner image is formed. Preferably, the running linear velocity of the transfer belt 104 is the same as the linear velocity of the photoreceptive drum 101. The length of the transfer belt 104 must be the same as or at least longer than the length of the recording medium S where the color toner image is finally transferred.

The transfer roller 105 is installed to face the transfer belt 104. The transfer roller 105 is separated from the transfer belt 104 while the color toner image is transferred to the transfer belt 104. When the color toner image is completely transferred to the transfer belt 104, the transfer roller 105 contacts the transfer belt 104 with a predetermined pressure to transfer the color toner image to the recording medium S. When the recording medium S to which the toner image is transferred passes through a fusing unit 106, the toner image is fused on the recording medium S by heat and pressure. A charger 107 initially charges the photoreceptive drum 101 to a uniform electric potential. A discharger 108 discharges any electrical charges remaining on the photoreceptive drum 101 after the image has been transferred.

The image forming process performed by the electrophotographic printer having the above-described structure is described below.

Color image information includes information on cyan (C), magenta (M), yellow (Y), and black (K) colors. In the present preferred embodiment, the color toner images corresponding to the cyan (C), magenta (M), yellow (Y), and black (K) colors are sequentially overlapped on the transfer belt 104 and the overlapped image is transferred to the recording medium S. Then, the transferred image is fused on the recording medium S so that a color image is formed.

When a light signal corresponding to the image information on cyan (C) color is scanned by the exposure unit 102 onto the photoreceptive drum 101 that has previously been charged to a uniform electric potential, resistance of a portion of the drum surface where the light is scanned decreases and as a result charges adhering to the external circumferential surface of the photoreceptive drum 101 dissipate. As a result, a difference in electric potential is generated between the scanned portion and the non-scanned portion of the photoreceptive drum 101 so that an electrostatic latent image is formed on the outer circumferential surface of the photoreceptive drum 101. When the electrostatic latent image approaches the developing unit 103C containing cyan (C) toner as the photoreceptive drum 101 rotates, the cyan (C) toner adheres to the electrostatic latent image so that a cyan toner image is formed. When the cyan toner image approaches the transfer belt 104 by the rotation of the transfer belt 104, the cyan toner image is transferred to the transfer belt 104 by the difference in electric potential with the transfer belt 104 and/or a contact pressure. When the cyan toner image is completely transferred to the transfer belt 104, the toner images corresponding to the magenta (M), yellow (Y), and black (K) colors are sequentially transferred to the transfer belt 104, in the same process, and overlapped thereon to form a color toner image. When the recording medium S passes between the transfer belt 104 and the transfer roller 105, the color toner image is transferred to the recording medium S. Next, the color toner image is fused by the fusing unit 106 onto the recording medium S by heat and pressure and the recording medium S is ejected, completing the image forming process.

The photoreceptive drum 101 and the transfer belt 104 are image holding bodies which temporarily hold a toner image before the toner image is transferred to the recording medium S. Some waste toner remains on the photoreceptive drum 101 and the transfer belt 104 in the process of transferring the toner image to the recording medium S via the photoreceptive drum 101 and the transfer belt 104. The waste toner remaining on the image holding bodies is preferably removed for the next printing. The removed waste toner is held in a storage container 200 and is then disposed of. In some cases, some waste toner reenters the developing unit to be reused. However, for a color image forming apparatus, since toner having different colors are mixed, generally, the waste toner cannot be reused.

Figure 4:
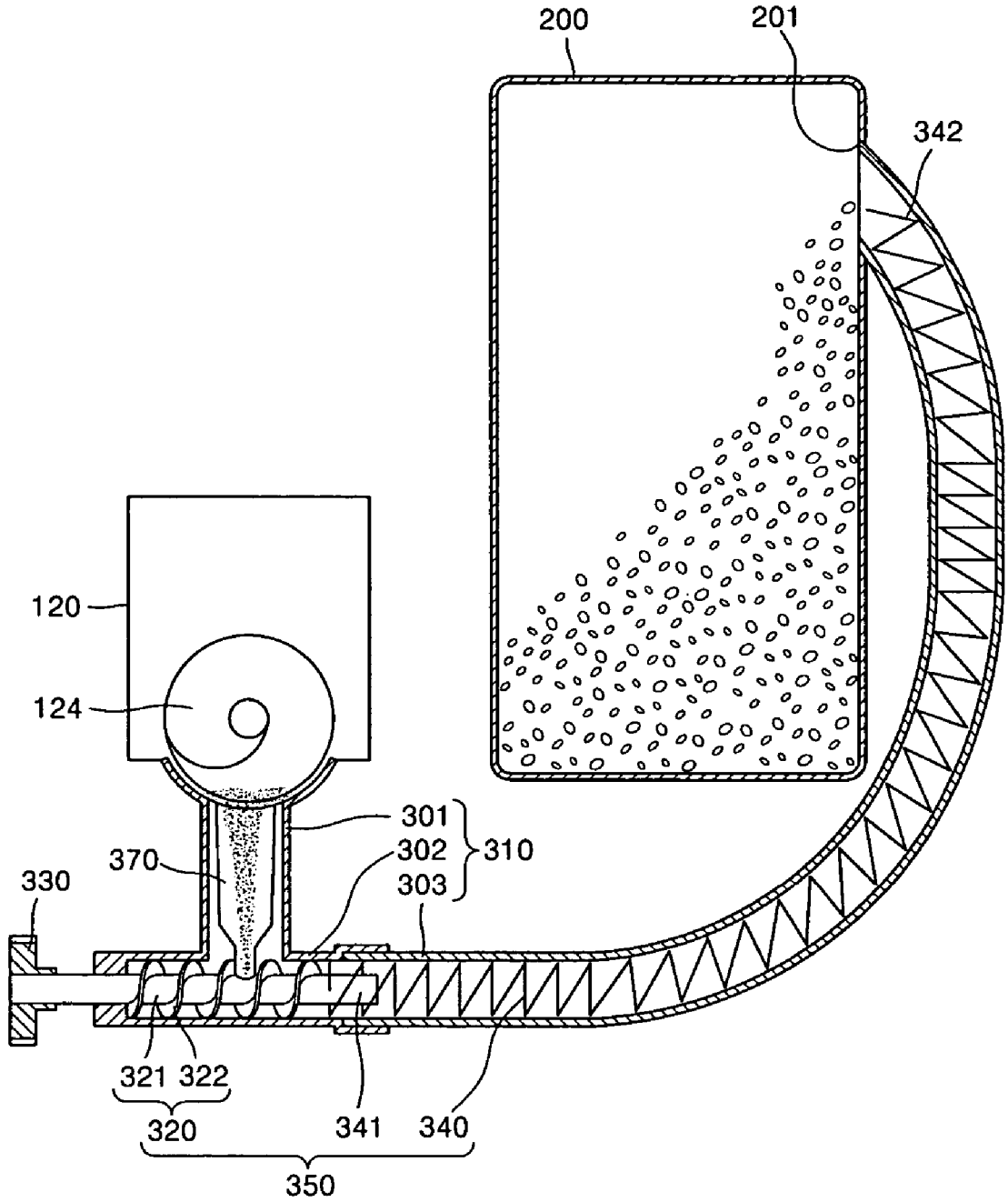
FIG. 4 is a sectional view illustrating the waste toner transfer apparatus shown in FIGS. 2 and 3.

Referring to FIG. 2, waste toner from the photoreceptive drum 101 is removed by a cleaning unit 120. The cleaning unit 120 includes a housing 121, a blade 122 contacting the photoreceptive drum 101 to squeegee the waste toner, and an auger 123 to transfer the waste toner toward an outlet 124 of FIG. 4 provided at one side end portion of the housing 121. Also, waste toner from the transfer belt 104 is removed by a cleaning unit 130. The cleaning unit 130 preferably has the same structure as that of the cleaning unit 120 for the photoreceptive drum 101.

In the storage container 200, an inlet 201 of FIG. 4, through which waste toner enters, is preferably disposed near the top of the container 200 to effectively hold the waste toner. In the embodiment of the invention shown in FIG. 2, where the transfer belt 104 is disposed above the photoreceptive drum 101, the waste toner removed from the transfer belt 104 by the cleaning unit 130 is transferred to the storage container 200 directly through the inlet 201 from the cleaning unit 130. However, the waste toner removed from the photoreceptive drum 101 by the cleaning unit 120 is transferred to the storage container 200 by a waste toner transfer apparatus 300 to overcome a difference in height between the cleaning unit 120 and the inlet 201 of the storage container 200.

FIG. 3 shows an electrophotographic printer according to another embodiment of the present invention. Referring to FIG. 3, a photoreceptive belt 112 is provided parallel to a transfer drum 113. The cleaning units 120 and 130 to remove waste toner from the photoreceptive belt 112 and the transfer drum 113 are provided. The electrophotographic printer having the above structure needs two waste toner transfer apparatuses 300 to transfer waste toner from the respective cleaning units 120 and 130 to the storage container 200.

Figure 5:
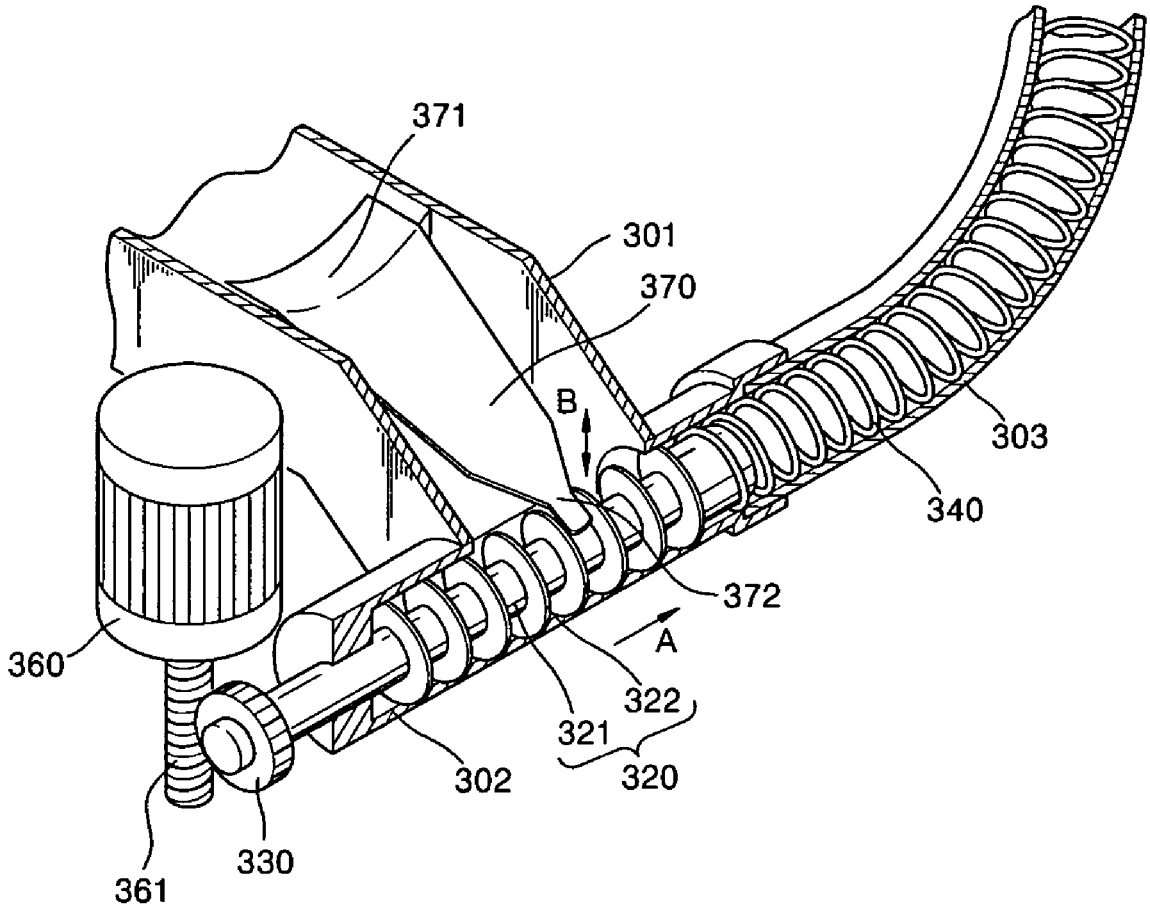
FIG. 5 is a perspective view illustrating the waste toner transfer apparatus shown in FIGS. 2 and 3.

FIGS. 4 and 5 are a sectional view and a perspective view, respectively, illustrating the waste toner transfer apparatus shown in FIGS. 2 and 3. Referring to FIGS. 4 and 5, a duct 310 is connected to the outlet 124 of the cleaning unit 120 and a transfer unit 350 is installed inside the duct 310. The duct 310 includes first through third ducts 301, 302 and 303, in the presently preferred embodiment. Thus, a waste toner transfer route is formed from the cleaning unit 120 to the storage container 200, via the first duct 301, the second duct 302 and the third duct 303.

The transfer unit 350 includes an auger 320. The auger 320 has a shaft 321 and a wing 322 having a spiral shape formed on the outer circumference of the shaft 321. A gear 330 is coupled to the shaft 321. A drive motor 360 has a rotation shaft to which a worm gear 361 connected to the gear 330 is coupled. The drive motor 360 rotates the auger 320. A spiral shaped conveying coil 340 may further be included in the transfer unit 350. One end portion 341 of the conveying coil 340 is coupled to the shaft 321 of the auger 320 and the other end portion 342 is extended to the storage container 200. The conveying coil 340 is rotated as the auger 320 rotates.

The first duct 301 is preferably installed to be inclined downward from the cleaning unit 120 toward the second duct 302 so that the waste toner can enter the second duct 302 by gravity. The auger 320 is installed in the second duct 302 and transfers the waste toner entering through the first duct 301 to the third duct 320. The third duct 303 preferably has a flexible circular pipe shape so as to be easily connected between the second duct 302 and the storage container 200. The conveying coil 340 is provided in the third duct 303.

An agitation member 370 is installed in the first duct 301. A first end portion 371 of the agitation member 370 is disposed close to an inlet side of the first duct 301 and a second end portion 372 contacts the auger 320. Thus, the agitation member 370 is inclined downward from the first end portion 371 toward the second end portion 372. Furthermore, the agitation member is preferably formed in a channel shape to help guide waster toner from the inlet side of the first duct 301 to the second end portion 372. The second end portion 372 of the agitation member 370 preferably has a soft curved shape so as to gently contact the shaft 321 and/or the wing 322 and move up and down as the auger 320 rotates. The agitation member 370 is preferably, but not necessarily, an elastic member. In a preferred embodiment, the agitation member 370 is made of a thin steel plate. However, it should be understood that a wide variety of materials could be used in the construction of an agitation member 370, including plastic. In this case, the first end portion 371 of the agitation member 370 is fixed to the inlet side of the first duct 301 and the second end portion 372 elastically (resiliently) contacts the auger 320. When the agitation member 370 is a non-elastic member, although not shown in the drawings, the first end portion 371 of the agitation member 370 is preferably installed at the first duct 301 so that it is capable of pivoting. Preferably, the agitation member 370 moves by being engaged with the transfer unit 350 as in the illustrated embodiment. However, an additional drive means (not shown) may further be included to move the agitation member 370.

The operation and effect of the waste toner transfer apparatus 300 is described below with reference to FIGS. 2 through 5.

The waste toner removed from the photoreceptive drum 101 by the cleaning apparatus 120 enters in the first duct 301. The waste toner falls on the agitation member 370 from the cleaning unit 120 by gravity and slides along the agitation member 370 which is inclined, to enter the second duct 302. When the drive motor 360 rotates, the auger 320 in the second duct 302 rotates and the conveying coil 340 in the third duct 303 also rotates. The waste toner in the second duct 302 enters the third duct 303 by being pushed by the spiral wing 322 of the auger 320 and is transferred to the storage container 200 along the conveying coil 340.

Part of the waste toner falling on the agitation member 370 does not enter in the second duct 302 due to an attraction force between the toner particles and tends to be accumulated on the agitation member 370. Accordingly, the first duct 301 may clog in time. To prevent this, in the waste toner transfer apparatus 300 according to an embodiment of the present invention, the agitation member 370 moves by being engaged with the transfer unit 350. As shown in FIG. 5, the second end portion 372 of the agitation member 370 is in contact with the auger 320. For the sake of explanation, it is assumed that the second end portion 372 initially contacts the shaft 321. When the auger 320 rotates, the wing 322 rotates while advancing in a direction A shown in FIG. 5. The second end portion 372 ascends as it contacts the wing 322 and then descends and contacts the shaft 321 as the auger 320 continuously rotates. Since the agitation member 370 moves up and down in a direction B shown in FIG. 5, the waste toner falling on the agitation member 370 does not accumulate and naturally enters the second duct 302.

In this embodiment, since the agitation member 370 acts as the channel to guide the waste toner from the cleaning unit 120 to the transfer unit 350, the waste toner does not accumulate in the first duct 301. As the waste toner slides down from the cleaning unit 120 to the transfer unit 350 through the agitation member 370 by gravity, moving the agitation member 370 in a normal direction to the direction of an axis of the transfer unit 350 can guide the waste toner to the transfer unit 350 more efficiently than moving the agitation member 370 in the same direction as the axis of the transfer unit 350.

Figure 6:
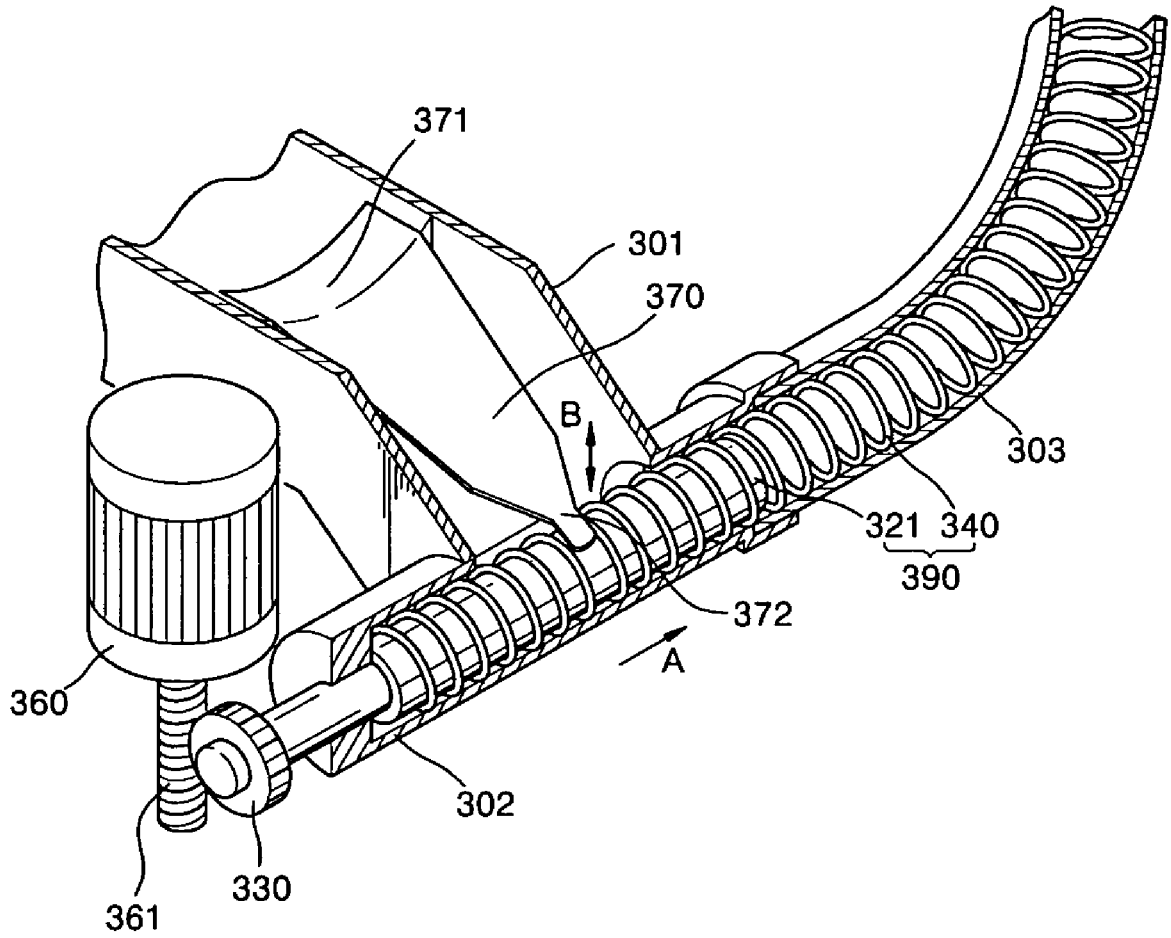
FIG. 6 is a perspective view illustrating the waste toner transfer apparatus according to yet another embodiment of the invention.

FIG. 6 shows a waste toner transfer apparatus according to another preferred embodiment of the present invention. Referring to FIG. 6, a transfer unit 390 includes a shaft 321 installed in the second duct 302 to rotate and the conveying coil 340 inserted around the shaft 321 and extending toward the third duct 303. The conveying coil 340 is inserted further along the shaft 321 so that it can contact the end portion 372 of the agitation member 370. Thus, as the conveying coil 340 rotates, the agitation member 370 in contact with the spiral of the conveying coil 340 moves up and down.

As described above, in the electrophotographic printer according to embodiments of the present invention, since the agitation member is provided, the waste toner effectively enters in the transfer unit by gravity and the agitation of the agitation member.

While this invention has been particularly shown and described with reference to preferred embodiments thereof, it will be understood by those skilled in the art that various changes in form and details may be made therein without departing from the spirit and scope of the invention as defined by the appended claims. For example, embodiments of the present invention could be employed in devices that use optical exposure units rather than laser scanning units to form a latent image on the photoreceptive drum or belt. Also, a non-photoreceptive drum or belt could also be used in a device utilizing an electrostatic print head, in which a latent image is formed onto an insulating surface of a drum or belt by depositing charge directly onto the insulating surface of the drum or belt. Devices that use a two-component solid toner could benefit from using a toner transfer device according to an embodiment of the present invention. Also, while multi-color printing devices have been described herein, those of ordinary skill in the art will readily appreciate that the concepts described herein can be applied to single color image forming devices as well.

What is claimed is:

1. A waste toner transfer apparatus in an electrophotographic printer for transferring waste toner removed by a cleaning unit from an image holding body where a toner image is temporarily held to a waste toner storage container, the waste toner transfer apparatus comprising:

a duct connecting the cleaning unit and the storage container;

a transfer unit installed in the duct for transferring the waste toner to the storage container; and an agitation member installed in the duct to move therein and shaped to guide the waste toner from the cleaning unit to the transfer unit.

2. The waste toner transfer apparatus as claimed in claim 1, wherein the agitation member moves by being engaged with the transfer unit.

3. The waste toner transfer apparatus as claimed in claim 2, wherein the transfer unit comprises an auger having a shaft and a spiral wing formed on an outer circumference of the shaft, and one end of the agitation member contacts the auger so that the agitation member moves as the auger rotates.

4. The waste toner transfer apparatus as claimed in claim 3, wherein the agitation member is formed of an elastic material and elastically contacts the auger.

5. The waste toner transfer apparatus as claimed in claim 3, wherein the transfer unit further comprises a conveying coil having one end portion coupled to the shaft and a spiral coil shape extended to the storage container, the conveying coil rotating as the auger rotates.

6. The waste toner transfer apparatus as claimed in claim 5, wherein the duct comprises:

a first duct extending downward from the cleaning unit;

a second duct connected to the first duct, in which the auger is installed; and a third duct connecting the second duct and the storage container, in which the conveying coil is installed;

wherein the agitation member is installed in the first duct.

7. The waste toner transfer apparatus as claimed in claim 2, wherein the transfer unit comprises:

a shaft which rotates; and a conveying coil inserted around one end portion of the shaft, having a spiral coil shape extending to the storage container, and rotated by the shaft;

wherein one end of the agitation member contacts the conveying coil and moves as the conveying coil rotates.

8. The waste toner transfer apparatus of claim 1, wherein the agitation member has a channel shape to guide waste toner from an inlet portion adjacent to the cleaning unit to a second end portion adjacent to the transfer unit.

9. The waste toner transfer apparatus of claim 1, wherein the agitation member is inclined from an inlet portion adjacent to the cleaning unit to a second end portion adjacent to the transfer unit.

10. An electrophotographic printer including an image holding body for temporarily holding a toner image in an image forming process, a cleaning unit for removing waste toner remaining on the image holding body, a waste toner storage container, and a waste toner transfer apparatus for transferring the waste toner from the cleaning unit to the storage unit, wherein the waste toner transfer apparatus comprises:

a duct connecting the cleaning unit and the storage container;

a transfer unit installed in the duct and for transferring the waste toner to the storage container; and an agitation member installed in the duct for moving therein and shaped for guiding the waste toner from the cleaning unit to the transfer unit.

11. The electrophotographic printer as claimed in claim 10, wherein the agitation member moves by engaging the transfer unit.

12. The electrophotographic printer as claimed in claim 11, wherein the transfer unit comprises an auger having a shaft and a spiral wing formed on an outer circumference of the shaft, and one end of the agitation member contacts the auger so that the agitation member moves as the auger rotates.

13. The electrophotographic printer as claimed in claim 12, wherein the agitation member comprises an elastic material and elastically contacts the auger.

14. The electrophotographic printer as claimed in claim 12, wherein the transfer unit further comprises a conveying coil having one end portion coupled to the shaft and a spiral coil shape extended to the storage container; wherein the conveying coil rotates as the auger rotates.

15. The electrophotographic printer as claimed in claim 14, wherein the duct comprises:

a first duct extending downward from the cleaning unit;

a second duct connected to the first duct, in which the auger is installed; and a third duct connecting the second duct and the storage container, in which the conveying coil is installed;

wherein the agitation member is installed in the first duct.

16. The electrophotographic printer as claimed in claim 11, wherein the transfer unit comprises:

a shaft which rotates; and a conveying coil inserted around one end portion of the shaft, having a spiral coil shape extending to the storage container, and rotated by the shaft;

wherein one end of the agitation member contacts the conveying coil to move as the conveying coil rotates.

17. The electrophotographic printer as claimed in claim 10, wherein the agitation member has a channel shape to guide waste toner from an inlet portion adjacent to the cleaning unit to a second end portion adjacent to the transfer unit.

18. The electrophotographic printer as claimed in claim 10, wherein the agitation member is inclined from an inlet portion adjacent to the cleaning unit to a second end portion adjacent to the transfer unit.

19. A method of transferring waste toner to a storage container in an electrophotographic printer, comprising:

cleaning waste toner from an image forming body;

utilizing an agitating member to agitate and guide the waste toner in a duct connected to a storage container; and transferring the toner to the storage container.

20. The method of transferring waste toner as claimed in claim 19, wherein the duct is connected between a cleaning unit adapted to perform the cleaning step and the storage container.

21. The method of transferring waste toner as claimed in claim 19, wherein the agitating member is installed in the duct.

22. The method of transferring waste toner as claimed in claim 21, wherein said transferring step is performed by a transfer unit.

23. The method of transferring waste toner as claimed in claim 22, wherein said transfer unit comprises an auger having a shaft and at least one spiral shaped wing; said transfer unit being installed in the duct; and further comprising rotating said auger.

24. The method of transferring waste toner as claimed in claim 23, wherein the agitating step further comprises contacting said agitating member with said transfer unit so that the agitating member moves as the auger rotates.

25. The method of transferring waste toner as claimed in claim 22, wherein said transfer unit comprises a shaft and a spiral shaped coil having at least one end connected to the shaft, said transfer unit being installed in the duct; and further comprising rotating said shaft.

26. The method of transferring waste toner as claimed in claim 25, wherein the agitating member contacts said transfer unit so that the agitating member moves as the coil rotates.

27. The method of claim 21, wherein said agitating member is formed in an included channel shape to guide the waste toner to the transfer unit as the agitating member moves.

28. The waste toner transfer apparatus as claimed in claim 1, wherein the agitation member moves in a direction normal to the direction of a longitudinal axis of the transfer unit.

29. The electrophotographic printer as claimed in claim 10, wherein the agitation member moves in a direction normal to the direction of a longitudinal axis of the transfer unit.

30. The method of transferring waste toner as claimed in claim 19, wherein the agitation step comprises contacting the agitation member with the transfer unit so that the agitation member moves in a direction normal to the direction of an axis of the transfer unit.

31. The waste toner transfer apparatus as claimed in claim 1, wherein the shape of the agitation member is a tapered shape.

32. The waste toner transfer apparatus as claimed in claim 1, wherein the shape of the agitation member is a concave shape.

33. The waste toner transfer apparatus as claimed in claim 10, wherein the shape of the agitation member is a tapered shape.

34. The waste toner transfer apparatus as claimed in claim 10, wherein the shape of the agitation member is a concave shape.

35. The waste toner transfer apparatus as claimed in claim 1, wherein the waste toner is guided by sliding along a surface of the agitation member from the cleaning unit to the transfer unit.

36. The waste toner transfer apparatus as claimed in claim 1, wherein, during transfer of the waste toner, the waste toner does not accumulate on a wall of the duct.

37. The waste toner transfer apparatus as claimed in claim 10, wherein the waste toner is guided by sliding along a surface of the agitation member from the cleaning unit to the transfer unit.

38. The waste toner transfer apparatus as claimed in claim 10, wherein, during transfer of the waste toner, the waste toner does not accumulate on a wall of the duct.

* * * * *